United States Patent [19]

Smith

[11] Patent Number: 4,479,640

[45] Date of Patent: Oct. 30, 1984

[54] FLAT PIECE FOLDING APPARATUS WITH VARIABLE SPEED, AND METHOD

[76] Inventor: Carol E. Smith, 2314 Merimac Dr., Charlotte, N.C. 28210

[21] Appl. No.: 517,080

[22] Filed: Jul. 22, 1983

[51] Int. Cl.[3] ..... B41L 43/00; A41H 33/00

[52] U.S. Cl. ..... 270/32; 223/37; 414/13

[58] Field of Search ..... 270/32; 223/37; 414/13; 38/141

[56] References Cited

U.S. PATENT DOCUMENTS

| | | | |
|---|---|---|---|
| 3,576,559 | 4/1971 | Gerstenberger | 414/13 |
| 3,706,450 | 12/1972 | Gerstenberger | 223/37 |
| 3,761,071 | 9/1973 | Behn | 223/37 X |
| 3,806,007 | 4/1974 | Grantham | 223/37 |
| 3,884,459 | 5/1975 | Gunn | 223/37 X |
| 3,926,424 | 12/1975 | Gerstenberger | 223/37 |
| 4,106,260 | 8/1978 | King | 223/37 X |
| 4,299,521 | 11/1981 | Jensen | 414/13 |
| 4,327,510 | 5/1982 | Grantham | 223/37 |

FOREIGN PATENT DOCUMENTS

| | | | |
|---|---|---|---|
| 80519 | 6/1983 | European Pat. Off. | 270/32 |
| 1436594 | 9/1964 | Fed. Rep. of Germany | 270/32 |
| 3011151 | 10/1981 | Fed. Rep. of Germany | 270/32 |
| 138086 | 10/1979 | German Democratic Rep. | 223/37 |
| 138342 | 10/1979 | German Democratic Rep. | 223/37 |

*Primary Examiner*—E. H. Eickholt

*Attorney, Agent, or Firm*—W. Thad Adams, III

[57] ABSTRACT

A folder 10 for folding flat piece laundry as delivered from an ironer is disclosed. Folder 10 includes a logic controller (70) which calculates the position on the laundry piece where the fold is to be made and activates air jets (57, 58 and 59) to make the fold at the proper position. The proper position is calculated by directly calculating the length of a laundry piece by providing a sprocket gear 43 which rotates in a fixed relationship to the speed of a motor (42) and the surface speed of a conveyor (12). A proximity switch (49) counts pulses as the sprocket gear 43 rotates. Each pulse defines a known increment of linear length of the conveyor (12) in fixed proportion to the rotation of the motor (42). In the method disclosed, one of the steps compensates for slippage of the laundry piece in the folder caused by operating the folder at a slightly greater speed than the ironer.

9 Claims, 10 Drawing Figures

FLAT PIECE FOLDING APPARATUS WITH VARIABLE SPEED, AND METHOD

TECHNICAL FIELD AND BACKGROUND OF THE INVENTION

This invention relates to an apparatus for folding flat piece laundry and including folding control means for calculating the position of a laundry on the conveyor of the folder and also calculating where the fold is to be made and activating the folding means to make a series of folds at the proper position so that the laundry piece is folded into a smaller, symmetrical size. The application also discloses a method for calculating the position of the laundry piece on the folder conveyor and calculating the position where the folds are to be made.

Folders of the general type disclosed herein are used primarily in large industrial and commercial institutions such as hospitals, colleges, military bases and hotels where large quantities of flat piece laundry are washed and folded. By "flat piece laundry" is meant primarily sheets, pillow cases, bed spreads, towels and other similar items which are, for the most part, symmetrical in shape and can be ironed and folded by automatic equipment without manual handling. However, the invention disclosed in this application is not so limited and would have application on folders designed to fold other types of fabric structures.

In general, a folder receives a flat piece of laundry from an ironer and through manipulation by mechanical or pneumatic means folds the flat laundry piece into several successive smaller sizes to form a neat, easily handled bundle. Since the laundry pieces are ordinarily handled by the machine without manual assistance, some automatic means is necessary to tell the machine when to make each fold. Unless the fold is made at the proper place, the edges and seams on opposite sides of the fold do not match and further processes in the folder may therefore carried out improperly. In addition, mismatched edges and seams result in a ragged, unneat package which requires more space for stacking and storing. The problem is made somewhat more difficult because the flat piece laundry, for example, a sheet, of a given nominal size may be several percent larger or smaller than the average size. Even a relatively small variation can cause a drastic change in the appearance of the folded piece if not compensated for. While variations in laundry piece size may be minimized to some extent it is virtually impossible to eliminate them because they occur for a variety of reasons, including size variation when manufactured, stretching or pulling as a result of previous washing or ironing processes and repairing rips and tears. Therefore, some means must be provided on a folding machine to determine where the fold is to be made on each laundry piece given the assumption that the fold position may be slightly different from one piece to the next.

The typical system presently in use involves sensing the present or absence of a laundry piece at a particular point on the folder conveyor. The sensor, which may be a photocell or some similar device, actuates a timer set to the surface speed of the belt. Passage of the laundry piece within the scan of the sensor activates a timer, which given the surface speed of the belt, predicts a time at which the fold point of the laundry piece will be in position for the fold to be made. There are a number of difficulties with this approach. First, the measurement of the laundry is only approximate. The accuracy of the measurement is further degraded because the timer is based on a set belt speed which may vary slightly even under ideal conditions. Furthermore, when the belt speed is changed the timer and all of its associated mechanics must be reset. Because of the difficulty in prior art systems of constantly resetting timers based on changing laundry piece sizes and belt speeds, folders are typically run at a set speed which is somewhat faster than the fastest ironing rate. The ironing rate varies greatly for different types of flat piece laundry. For example, flat polyester and cotton sheets can be dried and ironed very quickly because the polyester is hydrophobic and the sheet has therefore absorbed less moisture than an all-cotton sheet. Likewise, laundry pieces having a double thickness, such as pillowcases, require a slower ironing speed because of the greater thickness of moist fabric which must be dried for a given amount of ironer surface area. The speed of the ironer is very easily changed to account for different types of laundry pieces and fabric constructions. A substantial problem results, however, when an ironer processing, for example, pillowcases and therefore running at a relatively slow speed discharges the laundry pieces onto a folder running at a much faster rate. Static electricity often builds up on the dried fabric. If the laundry piece comes out of the ironer somewhat crooked, the piece is pulled sideways since the side to exit the ironer first is grabbed and pulled at a much more rapid rate that the other side which is still in the ironer. This creates wear and tear on the fabric as a result of its being jerked out of ironer. The net result is a lower quality fold because of less precision in handling the laundry piece. There are other disadvantages in the prior art system as well. Running the folder at a constant high speed to avoid having to make frequent speed changes causes greater wear and tear on the machine, consumes more power, creates a higher noise level and can result in more injuries to operators.

Another factor which prior art folders have not taken into account is that slippage very often occurs while the laundry piece is being processed by the folder, especially if the trailing end of the laundry piece is still in the ironer. In order to produce an accurate fold, some compensation for slippage of the laundry piece within the folder must be made.

SUMMARY OF THE INVENTION

Therefore, it is an object of the invention to provide a folder for folding flat piece laundry as delivered from an ironer which includes folding control means for calculating the position on the laundry piece where the fold is to be made and activating folding means to make the fold at the proper position.

It is another object of the present invention to provide a method and apparatus for folding flat piece laundry as delivered from an ironer which includes means for directing calculating the length of the laundry piece and determining from the length of the laundry piece the position of the fold.

It is yet another object of the present invention to provide an method and apparatus for folding flat piece laundry as delivered from an ironer which permits frequent and quick adjustment of a folder so that the folder runs in substantial synchronization with the speed of the ironer, therefore reducing wear and tear on the flat piece laundry and permitting a more accurate fold.

It is yet another object of the present invention to provide an method and apparatus for folding flat piece laundry as delivered from an ironer and which includes means for compensating for slippage by the laundry piece on the conveyor.

These and other objects and advantages of the present invention are achieved in the preferred embodiments of the method and apparatus below by providing conveyor means for receiving the laundry piece from the ironer and transporting the laundry piece to a delivery end of the folder, and folding means cooperating with the conveyor means for folding the laundry piece at least once at a pre-calculated fold point. Folding control means are provided for calculating the position on the laundry piece where the fold is to be made and activating the folding means to make the fold at the proper position.

Preferably, the folding control means comprises means for controlling the surface speed of the conveyor, means for directly calculating the length of the laundry piece and determining from the length thereof the position of the fold and means for activating the folding means to make the fold in the laundry piece.

According to one embodiment of the invention disclosed herein, the means for controlling the surface speed of the conveyor includes a variable speed motor for driving the conveyor which includes an input adapted to vary the motor speed responsive to a speed input from the ironer.

Also, the means for directly calculating the length of the laundry piece preferably includes means rotating in a fixed relationship to the speed of the motor and to the surface speed of the conveyor and having pulse means for generating pulses thereon. Each pulse defines a known increment of linear length in fixed proportion to the rotation of the motor and the surface speed of the conveyor. Sensing means sense the passage of a laundry piece from one end to the other past a fixed point. Computing means count the pulses occuring which the sensing means senses the passage of the laundry piece past the fixed point. The length of the laundry piece is therefore determined and the length thus determined is divided by an integer representing the inverse of the fraction of the length of the folding piece where the fold is to be made. When the proper point on the laundry piece has reached the place for the fold to be made, the folding means are activated and the fold is made.

In accordance with the embodiment disclosed herein, the folder makes first and second lateral folds and then makes one cross fold.

BRIEF DESCRIPTION OF THE DRAWINGS

Some of the objects of the invention have been set forth above. Other objects and advantages of the invention will appear as the description of the invention proceeds, when taken in conjunction with the following drawings, in which.

DESCRIPTION OF THE PREFERRED EMBODIMENT

Figure 1:
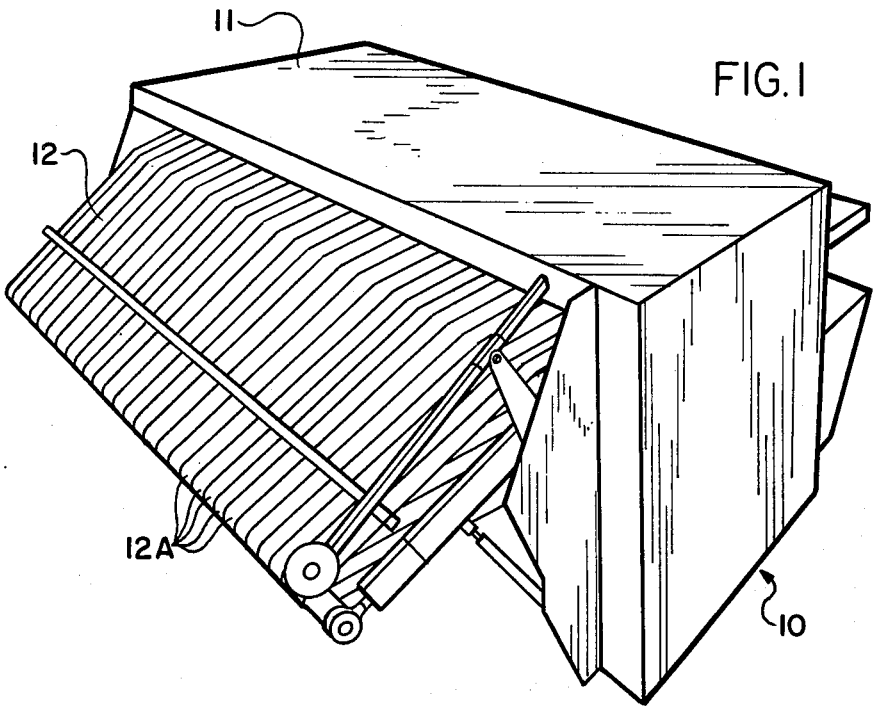
FIG. 1 is a perspective view of the end of the folder which receives the laundry from the ironer.
Figure 2:
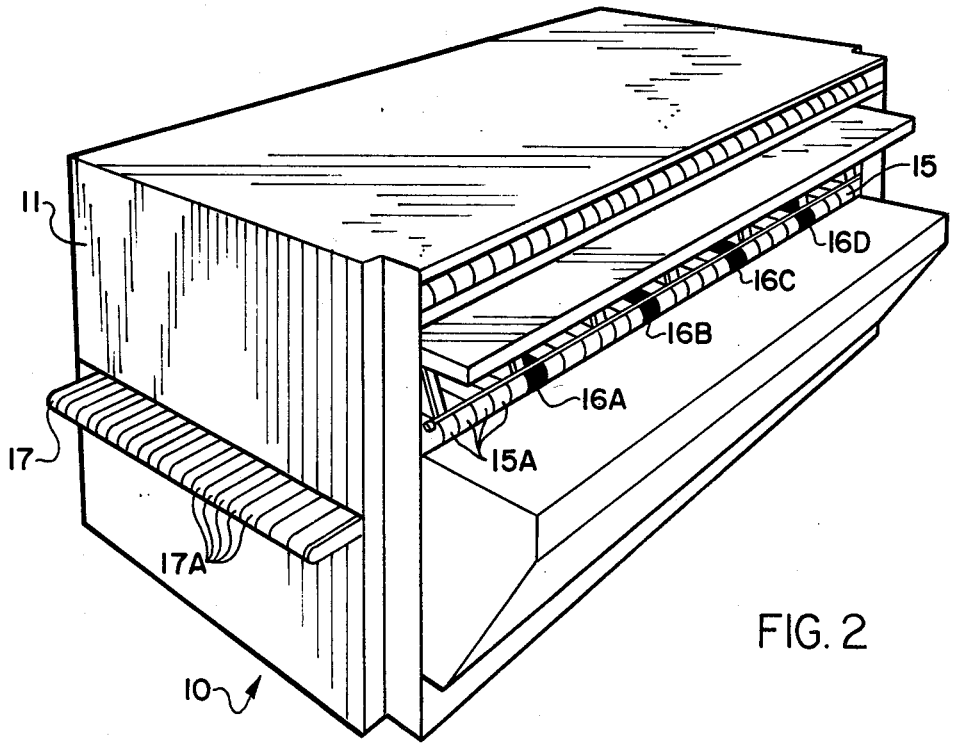
FIG. 2 is a perspective view of the delivery end of the folder.

Referring now specifically to the drawings, a preferred embodiment of the folder according to the present invention is shown in FIGS. 1 and 2 and generally indicated at broad reference numeral 10. Folder 10 includes a housing 11 which supports and encloses the structure of folder 10. Folder 10 includes a first lateral fold conveyor 12 which receives flat piece laundry, such as a sheet, from an ironer in flat, spread out condition. Conveyor 12 is formed of a large number of relatively, narrow, parallel and closely spread-apart belts 12*a*. Also shown in FIGS. 1 and 2 is a first cross-fold conveyor 15 also formed of relatively narrow belts 15*a*. The folder shown in FIGS. 1 and 2 has four lanes, each of which is individually capable of receiving and correctly folding successive pieces of flat laundry as received from an ironer onto the first lateral fold conveyor 12. As is shown in FIG. 2, the first cross-fold conveyor includes feed slots 16*a* through 16*d*, through which each laundry piece is passed as the cross-fold is made. This procedure will be described in more detail below. However, the number of lanes on a given folding machine is arbitrary and the principles of this invention are equally applicable to folders having only one lane or any larger number of lanes. As the description of this invention proceeds, reference will be made for purposes of clarity and brevity to the operation of the invention on a single lane.

FIG. 2 also shows a second cross-fold conveyor 17 formed on a number of parallel belts 17*a* which receives the cross-folded laundry from first cross-fold conveyor 15 through the individual feed slots 16*a* through 16*d*.

Figure 3:
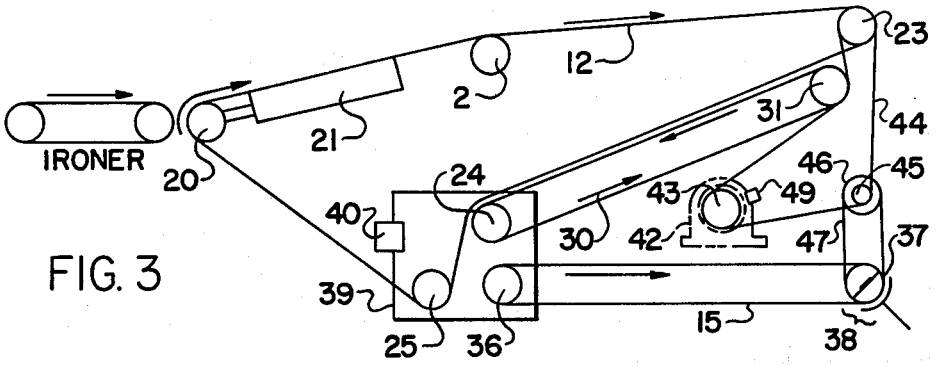
FIG. 3 is a schematic view of the conveyor and drive arrangement of the folder shown in FIGS. 1 and 2.

Referring now to FIG. 3, the conveyor and drive diagram of folder 10 is shown. First lateral fold conveyor 12 extends around a nose roller 20 which can be adjusted by a conveyor length and tension adjustment cylinder 21. It then passes over a support roller 22 and around a lateral fold roller 23. The conveyor 12 moves downwardly around rollers 24 and 25 and then back to the nose roller 20, completing the circuit. As shown in FIG. 3, conveyor 12 rotates clockwise.

A second lateral fold conveyor 30 is positioned beneath first lateral fold conveyor 12 and rotates in a counterclockwise direction around a lateral fold roller 31 and a roller 24. As can be seen, the upper surface of second lateral fold conveyor 30 parallels along its extent a length of the lower run of first lateral fold conveyer 12 in very closely spaced-apart relation. Positioned below second lateral fold conveyor 30 is the first cross-fold conveyor 15 which moves in a clockwise direction around two spaced-apart rollers 36 and 37. Roller 37 includes a clutch and brake assembly 38, the purpose of which will be described in further detail below.

Rollers 24, 25, and 36 are all contained within a roller nest frame 39. Tension on the rollers is controlled by a spring loading device which is shown schematically at 40. First and second lateral fold conveyors 12 and 30 and first cross-fold conveyor 15 are all driven by a variable speed motor 42 from a sprocket gear 43. A chain 44 connects sprocket gear 43 with sprocket gears on rollers 23 and 31 which drive conveyors 12 and 30, respectively, and also a sprocket gear 45 which is connected by a common shaft to a roller 46.

A chain 47 between roller 46 and roller 37 drives cross-fold conveyor 15.

Also shown in FIG. 3 is a magnetic proximity switch 49 which is positioned in very close, spaced-apart relation to sprocket gear 43 on motor 42. Proximity switch 49 senses the passage of individual sprocket teeth and intervening spaces as sprocket gear 43 rotates, and sends pulses to a counter. The counter is an integral part of a folding control means 70, which generally comprises a suitable logic processor which receives inputs, processes them and generates suitably timed outputs as will be discussed in more detail below and referred to as an electronic logic controller 70. The drive system described in FIG. 3 is designed to drive conveyors 12, 30 and 15 at the same surface speed by direct connection through chains 44 and 47. Therefore, by counting the number of sprocket teeth and spaces on gear 43 which are sensed by proximity switch 49, the distance travelled by the conveyors can be precisely determined. For example, in a preferred embodiment of the invention sprocket gear 43 has $\frac{1}{4}''$ sprocket teeth separated by $\frac{1}{4}''$ spaces. The cause of the gearing and lower sizes on the preferred embodiment, $\frac{1}{4}''$ rotational movement of the tooth on sprocket gear 43 translates into $\frac{3}{8}''$ forward surface movement of conveyors 12, 30 and 15. Thus, magnetic proximity switch 49 counts pulses, each pulse equalling a pre-determined linear distance without regard to time or speed. As a result, the speed of motor 42 can be increased or decreased as frequently as desired with a corresponding increase or decrease in the number of pulses counted by proximity switch 49 during a given occurence, such as the passage of a laundry piece past a fixed point.

Figure 4:
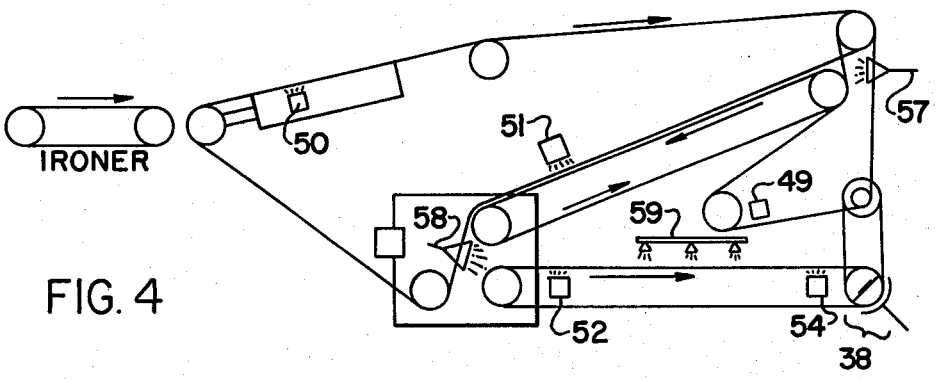
FIG. 4 is a schematic view similar to that in FIG. 3 but showing the position of the air jet nozzles which make the laundry folds.

Referring now to FIG. 4, a simplified schematic similar to that of FIG. 3 is shown which also includes representations of other important components. A first lateral fold photocell 50, a second lateral photocell 51, a safety photocell 52 and a cross-fold photocell 54 are shown. These photocells are positioned within the runs of their respective conveyors, as shown, and are directed upwardly through gaps between the individual, relatively narrow belts which make up the conveyors. Each of the photocells is therefore able to sense the presence on its conveyor of a flat laundry piece. A set of photocells as described above is provided for each lane on the folder 10.

Figure 5:
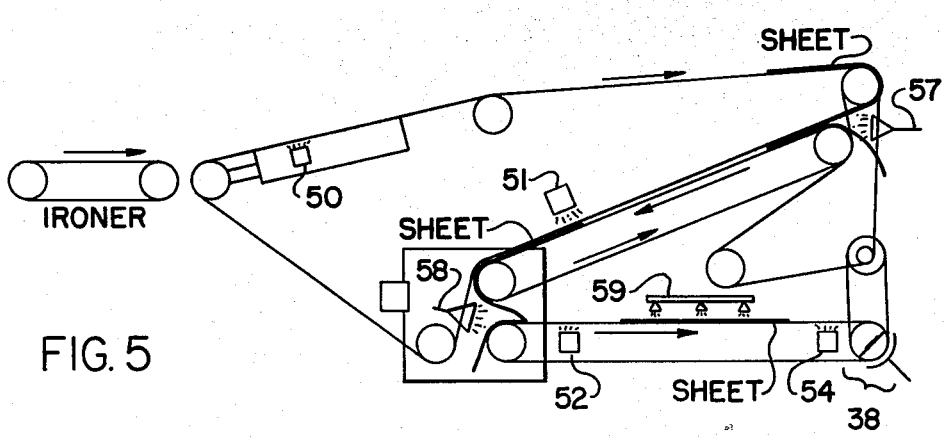
FIG. 5 is a view similar to that in FIG. 4 and showing in addition to the air jet nozzles the placement of the photocell sensors and a schematic presentation of laundry being delivered through the system.
Figure 6:
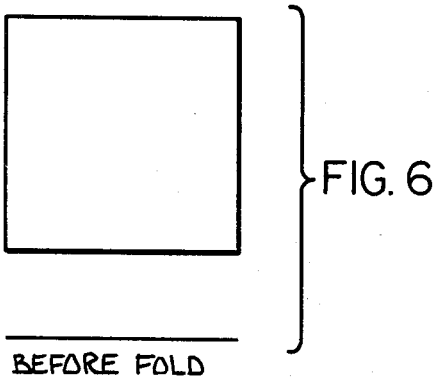
FIG. 6 represents a flat laundry piece as it is delivered to the folder.

Also shown in FIG. 4 is a first air jet assembly 57, a second air jet assembly 58 and a third air jet assembly 59. Air jet assemblies 57, 58 and 59 each define a location on folder 10 where a fold is placed, as is illustrated schematically in FIG. 5. A sheet is shown on the first lateral fold conveyor 12. The leading edge of the sheet has draped over the first lateral fold roller 23 and, at the appropriate time, air jet assembly 57 has blown a jet of high velocity air into the space between the lower run of first lateral fold conveyor 12 and the upper run of the second lateral fold conveyor 30. The crease in the sheet formed by the blast of air is captured by the adjacent runs of conveyors 12 and 30 which are moving in the same direction, and form a nip, pulling the sheet between conveyors 12 and 30 and downwardly along the length of conveyor 30. If the air blast from air jet assembly 57 has been directed at the proper place on the sheet, the sheet will be folded in half. The sheet proceeds down the top of conveyor 30 until it drapes off the end of roller 24. At the appropriate time, air jet assembly 58 projects a blast of air towards the sheet doubling it over and causing it to drape, again in half, on the upper run of first cross-fold conveyor 15. It is then conveyed along the top run of conveyor 15 until it is aligned under air jet assembly 59. Air jet assembly 59 is positioned to project a blast of air which is in longitudinal alignment with the direction of movement of conveyor 15 and, described above with reference to FIG. 2, directs the blast of air directly into one of the slots **16*a* through 16*d*. Nip rolls (not shown) under cross-fold conveyor 15 grip the sheet as the air blast projects it downwardly off of the upper run of the first cross-fold conveyor 15 and again folds it in half and drops it on the second cross-fold conveyor 17, which moves at right angles to the direction of movement of the other conveyors and moves the folded piece to one end of folder 10 for removal. FIG. 6 illustrates a hypothetical sheet in its flat, open position as it is fed to folder 10** from an ironer.

Figure 7:
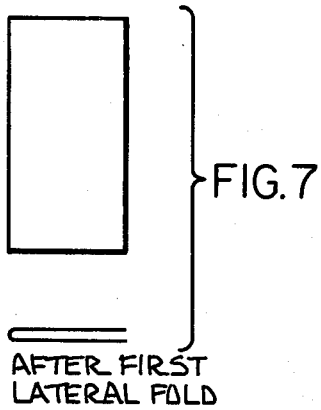
FIG. 7 represents a laundry piece after a first lateral fold.
Figure 8:
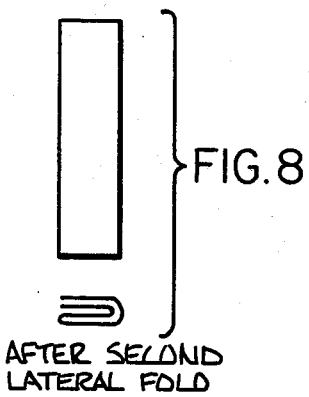
FIG. 8 represents the laundry piece in FIG. 7 after a second lateral fold.
Figure 9:
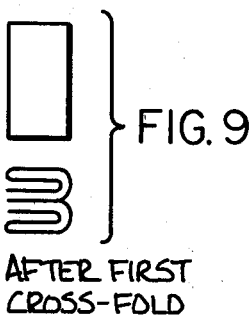
FIG. 9 represents the laundry piece shown in FIG. 8 after a first cross fold; and, FIG. 10 is a block schematic diagram of the folding control portion of the folder.

FIG. 7 shows the same piece of fabric after it has been folded once at the first lateral fold position defined by air jet assembly 57. FIG. 8 shows the size of the piece after it has been folded at the second lateral fold position defined by air jet assembly 58. Finally, FIG. 9 illustrates the relative size of the sheet after it has been folded at the point defined by the cross-fold air jet assembly 59. Note that the fold in the sheet which resulted in the size shown in FIG. 9 occured at right angles to the two previous folds shown in FIGS. 7 and 8, respectively.

Figure 10:
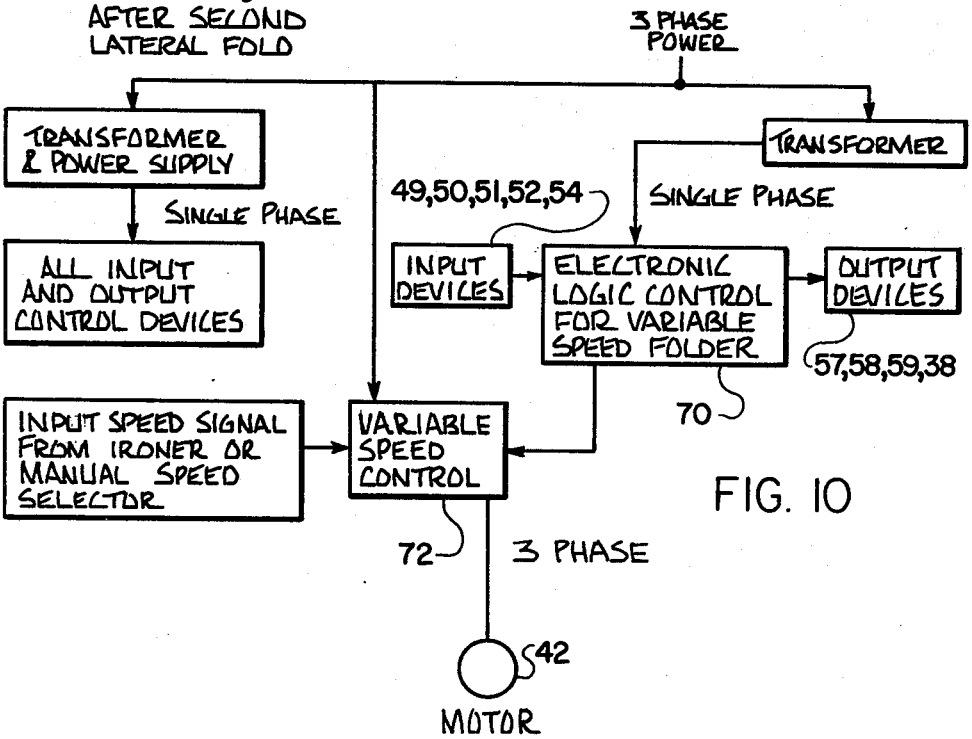

Referring back now more specifically to FIG. 4, as sensor, such as photocell 50 detects the presence of a sheet which has been received onto received conveyor 12 from the ironer. At the instant that photocell 50 first detects the presence of the leading edge of the sheet on conveyor 12, proximity switch 49 begins sending pulses generated by the sprocket teeth 43 to the electronic logic controller 70 shown in FIG. 10. As the sheet proceeds along the top run of conveyor 12, the pulse count accumulates at the rate of one pulse for each $\frac{3}{8}''$ of sheet moving past photocell 50. Of course, any other suitable ratio of motor rotation to conveyor linear movement could be adopted.

As the trailing edge of the sheet passes outside the scan of photocell 50, the pulse count is stopped and logic controller 70 divides the pulse count by two if the sheet is to be folded in half. Dividing the pulse count by two locates a position on the sheet where the fold should be made. Logic controller 70 then calculates the further distance required for the fold point to arrive precisely in front of the air jet assembly 57. When the fold point reaches air jet assembly 57, it is activated and the fold is made as described above. In the meantime, photocell 50 has been reset and is tracking the progress of the next sheet along conveyor 12.

The once folded sheet proceeds down the upper run of conveyor 30 towards photocell 51. When the leading edge of the sheet reaches photocell 51, a countdown towards zero begins from a number calculated by dividing the total length of the sheet before the first fold by four. This number defines the point on the sheet where the second fold will be made. Logic controller 70 activates air jet assembly 58 when the calculated fold point of the sheet has been reached. Photocell 51 does not need to sense the trailing edge of the sheet since the total length of the sheet has already been determined by photocell 50. Since this length is known, only the leading edge of the sheet need by located in order to determine where the second lateral fold should go.

Once the twice folded sheet is deposited on the upper run of cross-fold conveyor 15, it is sensed by the safety photocell 52. As long as photocell 52 senses the presence of a sheet over it, the cross-fold at air jet assembly 59 cannot take place. When the leading edge of the sheet reaches cross-fold photocell 54, the clutch and brake assembly 38 is actuated, immediately stopping the rotation of conveyor 15. As is shown in FIG. 5, the sheet is positioned directly under cross-fold air jet assembly 59 and has moved past the safety photocell 52. Since safety photocell 52 does not sense the presence of the sheet, logic controller 70 permits the cross-fold, air jet assembly 59 to cross-fold the sheet and deposit it onto the second cross-fold conveyor 17. It should be noted that cross-fold photocell 54 does not provide an input for a calculation function, but merely activates the clutch and brake assembly 38, stopping the conveyor. Since the fold which takes place on cross-fold conveyor 15 is made at right angles to the previous lateral folds, the proper alignment of the sheet on conveyor 15 is the important criteria.

To this point, a set speed of motor 42 has been assumed. However, motor 42 is preferably an AC or DC motor with a variable speed control 72. The variable speed control 72 is controlled by means of a signal transmitted to it by a speed signal from the ironer or by a manual speed selector (see FIG. 10). According to a preferred embodiment of the invention, the ironer sends a signal to the variable speed control 72 which causes motor 42 to adjust itself accordingly. Typically, motor 42 will be set to run folder 10 at a very slightly greater rate of speed than the ironer, sufficient to keep the laundry pieces in a flat, ironed condition without stretching or tearing the laundry piece.

It is anticipated that the folding control means in the form of the logic controller 70 will be comprised of a solid state integrated circuit designed especially to carry out the particular functions described above, but otherwise conventional in component design and structure. However, thus far the logic controller 70 for the folder 10 described above has constituted an Allen-Bradley Mini PLC-2115 programmable logic controller in order that circuit and programming configurations could be changed according to a number of test variables. In either case, the circuit schematic is summarized in FIG. 10.

The procedures outlined above result in a highly accurate fold under numerous speed conditions. The fold can be made even more accurate by calculating the slip which results from operating folder 10 at a very slightly greater speed than the ironer. By slip is meant the retarding effect on the laundry piece by the ironer which causes the sheet to be advanced along conveyor 12 at a slightly lesser rate than would be otherwise indicated by the photocell 50 and the magnetic proximity switch 49. Compensation for slippage is therefore made in accordance with the following formulae:

$$F1 = L1 - \frac{[PC - (PC \div K)]}{2} \quad (1)$$

Where

F1 = First fold point by Laundry piece

L1 = Distance on conveyor 12 from photocell 50 to fold point at air jet assembly 57;

PC = Number of pulses counted by photocell 50;

K = Constant (ratio of Ironer to folder speed expressed as a whole number);

2 = Laundry piece after folding will be one-half length of unfolded piece.

$$F2 = L2 - \frac{[PC - (PC \div K)]}{4} \quad (2)$$

Where

F2 = Second fold point on laundry piece;

L2 = Distance on conveyor 30 from photocell 51 to air jet assembly 58;

PC = Number of pulses counted by photocell 50;

K = Constant (ratio of Ironer to folder speed expressed as a whole number;

4 = Laundry piece after folding will be one-fourth length of unfolded piece

The formulae recited above take into account that the number of pulses "PC" will indicate a fabric piece length which is slightly greater than the actual length of the fabric piece because of the slip. When photocell 50 senses the trailing edge of the sheet, the fold point of the sheet is calculated using the above formulae. Then the logic controller 70 counts down to zero. When zero is reached the fabric piece is at the precise location in front of air jet assembly 57 so that the fold can be properly made.

Likewise, when the leading edge of the once folded sheet reaches photocell 51, logic controller 70 counts down to zero from the number computed in accordance with Formula #2. When zero is reached, the fold is made by air jet assembly 58.

As is clear, the apparatus and method described above is applicable to folders making any number of lateral and/or cross-folds, subject only to the requirement that a certain number of variables be specified and determined. In accordance with the method according to this invention, the surface speed of the folder conveyors is first determined. The presence over a fixed point on the conveyor of a laundry piece is sensed. With these two variables, the distance travelled by the conveyor belt during the presence of the laundry piece over the fixed point on the conveyor can be calculated. In accordance with this invention, this is done by counting pulses during the time that the sensing operation is taking place. The pulses have a fixed relation to the distance travelled by the conveyor and, as disclosed above, constitute the rotation of the motor at a particular speed.

Then, the ratio of the feed rate of the ironer to the surface speed of the folder conveyor is determined. The distance from the fixed point where the presence of the laundry piece is sensed to the point where the fold will be made is ascertained, as is the type of fold to be made. With this information, the next step in the method can be performed, which involves determining where to crease the laundry piece according to the formula described above. The laundry piece is transported by the conveyor to the position where the fold is to be made. At that point, the folder is activated for folding the laundry piece at the calculated fold point. Second and subsequent folds can be made at the appropriate point by use of the second formula recited above.

An apparatus and method for folding flat piece laundry as delivered from an ironer is disclosed and described above. Various details of the invention may be changed without departing from its scope. Furthermore, the foregoing description of the preferred embodiment of the apparatus and method according to the present invention is provided for the purpose of illustration only and not for the purpose of limitation—the invention being defined by the claims.

I claim:

1. A method for determining the proper fold points on a laundry piece delivered from an ironer to a conveyor belt-type folding machine, including compensation for slippage of the laundry piece in the folder, said method including the steps of:

(a) determining the surface speed of the folder conveyors;

(b) sensing the presence over a fixed point on the conveyer of the laundry piece;

(c) calculating the distance travelled by the conveyor belt during the presence of the laundry piece over the fixed point on the conveyor is sensed by counting pulses during said sensing which have a fixed relation to the distance travelled by the conveyer;

(d) determining the ratio of the feed rate of the ironer to the surface speed of the folder conveyer;

(e) determining the distance from the fixed point where the presence of the laundry piece is sensed to the point where the fold will be made;

(f) determining the type of fold to be made;

(g) determining where to crease the laundry piece to make the fold according to the formula:

$$F1 = L1 - \frac{[PC - (PC \div K)]}{2}$$

Where

F1=First fold point on laundry piece;

L1=Distance from sensor at fixed point on the conveyor to the point where the fold will be made;

PC=Number of pulses counted;

K=Constant (ratio of ironer to folder speed expressed as a whole number);

2=Laundry piece after fold will be one-half length of unfolded laundry piece;

(h) transporting the laundry piece by conveyor to the position where the fold is made;

(i) activating a folder for folding the laundry piece at the calculated fold point.

2. A method according to claim 1 wherein a second fold is placed in the laundry according to the additional steps of:

(a) sensing the arrival at a second fixed point of the leading edge of the once folded laundry piece;

(b) determining the distance from the sensor at the second fixed point to the place where the second fold is inserted;

(c) determining the fold to be placed in the laundry piece;

(d) determining the fold point on the laundry piece according to the formula:

$$F2 = L2 - \frac{[PC - (PC \div K)]}{4}$$

Where

F2=Second fold point on laundry piece;

L2=Distance from sensor at second fixed point to the second fold position;

PC=Number of pulses counted;

K=Constant (ratio of ironer to folder speed expressed as a whole number)

4=Laundry piece after fold will be one-fourth length of unfolded laundry piece.

(e) transporting the laundry piece by conveyor to the position where the fold is made;

(f) activating a folder for folding the laundry piece at the calculated fold point.

3. A folder for folding flat piece laundry as delivered from an ironer, and comprising:

(a) conveyor means for receiving the laundry piece from the ironer and transporting the laundry piece to a delivery end of the folder;

(b) folding means cooperating with said conveyor means for folding the laundry piece at least once at a precalculated fold point after the laundry piece has been received from the ironer and before it has been transported to the delivery end of the folder; and, (c) folding control means for calculating the position on the laundry piece where the fold is to be made and activating said folding means to make the fold at the proper position, said folding control means including:

(i) means for controlling the surface speed of said conveyor means;

(ii) means for directly calculating the length of the laundry piece and determining from the length thereof the position of the fold; and, (iii) means for activating said folding means to make the fold in the laundry piece.

4. A folder according to claim 3, wherein said means for controlling the surface speed of said conveyor means includes:

(a) a variable speed motor for driving said conveyor means, said variable speed motor including an input adapted to vary the motor speed responsive to a speed input from the ironer; and, (b) wherein said means for directly calculating the length of a laundry piece includes:

(i) means rotating in a fixed relationship to the speed of said motor and to the surface speed of said conveyor means and having pulse means thereon for generating pulses, each pulse defining a known increment of linear length in fixed proportion to rotation of said motor and surface speed of said conveyor means; and, (ii) sensing means for sensing the passage of a laundry piece from one end to the other past a fixed point and computing means for counting the pulses occurring while said sensing means senses the passage of a laundry piece past the fixed point, for determining the length of the laundry piece and dividing the length thereby calculated by an integer representing the inverse of the fraction of the length of the laundry piece where the fold is to be made, and for initiating operation of said activating means.

5. A folder according to claim 4, wherein means rotating in a fixed relationship to the speed of said motor includes a sprocket gear having a pre-determined number of teeth thereon and said sensing means includes a magnetic proximity switch which senses the teeth and spaces as they pass thereby, and conveys them to said computing means.

6. A folder according to claim 3, wherein said conveyor means comprises:

(a) a first lateral fold conveyor for receiving the laundry piece from the ironer; a second lateral fold conveyor for receiving the laundry piece from said first lateral fold conveyor, and a first cross-fold conveyor receiving the laundry piece from said second lateral fold conveyor, said first and second lateral fold conveyors and said first cross-fold conveyors being driven at the same surface speed; and wherein, (b) said folding means include first, second and third air jet assemblies activated by said activating means and cooperating with said first and second lateral fold conveyors and said first cross-fold conveyor, respectively, for making two successive lateral folds in said laundry piece and a first cross-fold, in each case matching the dimensions of the laundry piece on both sides of each fold to define a neat, symetrically folded laundry piece.

7. A folder according to claim 6 wherein said means for directly calculating the length of the laundry piece and determining the position of the fold includes:

(a) a photocell positioned in stationary relationship to said first lateral fold conveyor for scanning the laundry piece carrying surface of said first lateral fold conveyor to determine the presence or absence of a moving laundry piece;

(b) sensing means cooperating with said photocell for determining the length of the laundry piece by measuring the distance travelled by said first lateral fold conveyor while said laundry piece is present within the scan of said photocell;

(c) computing means for dividing the length of the laundry piece by an integer which is the inverse of the fraction of the length of the laundry piece where the fold is to be made.

8. A folder according to claim 6 wherein:

(a) said first air jet assembly is positioned at a fold point defined by the juncture of the downstream end of said first lateral fold conveyor and the upstream end of said second lateral fold conveyor for blowing a crease into the laundry piece as the laundry piece is picked up by said second fold conveyor;

(b) said second air jet assembly is positioned at a second fold point defined by the juncture of the downstream end of the second lateral fold conveyor and the upstream end of the first cross-fold conveyor for blowing a crease into the laundry piece as the laundry piece is picked up by said first cross-fold conveyor; and, (c) said third air jet assembly is positioned in longitudinal alignment with said first cross-fold conveyor and places a cross-fold in the laundry piece by blowing a crease therein at right angles to the previous folds and displacing the folded laundry piece downwardly through spaces in said cross-fold conveyor onto a second cross-fold conveyor moving at right angles thereto.

9. A folder according to claim 4, wherein means for directly calculating the length of a laundry piece includes means for compensating for slippage of the laundry piece on the conveyor means caused by operating the folder at a slightly greater feed rate than the ironer.

* * * * *